US006807381B2

(12) United States Patent
Sawano

(10) Patent No.: US 6,807,381 B2
(45) Date of Patent: Oct. 19, 2004

(54) COLOR IMAGE FORMING APPARATUS HAVING MULTIPLE DEVELOPING DEVICES

(75) Inventor: Ichiro Sawano, Izumisano (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 10/372,810

(22) Filed: Feb. 26, 2003

(65) Prior Publication Data

US 2003/0165347 A1 Sep. 4, 2003

(30) Foreign Application Priority Data

Mar. 1, 2002 (JP) ..... 2002-055196

(51) Int. Cl.[7] ..... G03G 15/08
(52) U.S. Cl. ..... 399/12; 399/227
(58) Field of Search ..... 399/12, 13, 119, 399/120, 223, 227

(56) References Cited

U.S. PATENT DOCUMENTS 4,611,899 A 9/1986 Kasamura et al.
5,014,094 A * 5/1991 Amitani et al. ..... 399/12
5,528,349 A 6/1996 Satake
5,530,531 A * 6/1996 Girard ..... 399/120
5,768,662 A * 6/1998 Sugihara et al. ..... 399/119
5,983,059 A 11/1999 Oka et al. ..... 399/262
6,549,731 B1 * 4/2003 Yoshida et al. ..... 399/12
6,600,881 B2 * 7/2003 Cornelius ..... 399/12

* cited by examiner

*Primary Examiner*—William J. Royer
(74) *Attorney, Agent, or Firm*—Morrison & Foerster LLP

(57) ABSTRACT

In a color image forming apparatus in which multiple developing devices housing toners of different colors are held by support members at prescribed locations on a rotatable support unit, a guide member is mounted to one side end of each developing device, engaging members having different configurations are disposed in the guide members, and the multiple developing devices are placed at prescribed locations on a the rotatable support unit by having the engaging members of the guide members mounted to adjacent developing devices engage with each other, enabling each developing device to be placed on the prescribed support member easily while using developing devices having a uniform configuration.

12 Claims, 6 Drawing Sheets

PRIOR ART

COLOR IMAGE FORMING APPARATUS HAVING MULTIPLE DEVELOPING DEVICES

CROSS-REFERENCE TO RELATED APPLICATIONS

This application is based on application No. 2002-55196 filed in Japan, contents of which are hereby incorporated by reference.

BACKGROUND OF THE INVENTION

1. Field of the Invention

The present invention relates to a color image forming apparatus such as a color copying machine or a color printer used to obtain color images, and more particularly to a color image forming apparatus in which multiple developing devices that house toners of various colors are held by support members that are disposed at prescribed locations on a rotatable support unit, and which performs development by rotating the rotatable support unit to sequentially lead each developing device to a position facing an image carrier.

2. Description of the Related Art

Color image forming apparatuses such as color copying machines and color printers that obtain color images using multiple developing devices housing toners of different colors have been in use in recent years.

As one such color image forming apparatus, an apparatus has been in use in which four developing devices 10*a*–10*d*, each of which houses a toner of a different color, are held by prescribed support members 21*a*–21*d* on a rotatable support unit 20, the rotatable support unit 20 is rotated to sequentially lead each developing device 10*a*–10*d* to a position facing an image carrier P, and the different color toners are sequentially supplied to the image carrier P from the toner carriers 11*a*–11*d* of the developing devices 10*a*–10*d* to develop a full-color image, as shown in FIG. 1.

The color image forming apparatus described above gives rise to the problem, however, that unless the developing devices 10*a*–10*d* are held by the prescribed support members 21*a*–21*d*, respectively, on the rotatable support unit 20, toner of the wrong color is supplied to the image carrier P, resulting in a failure to obtain an image having the desired coloring.

Therefore, in the conventional art, as shown in FIG. 1 referred to above, for example, verification protrusions 23*a*–23*d* are disposed on a partition member 22 that separates the support members 21 *a*–21*d* on the rotatable support unit 20 such that the positions of the verification protrusions differ for each support member 21*a*–21*d*, and verification concavities 12*a*–12*d* are disposed in the developing devices 10*a*–10*d* such that the verification concavities 12*a*–12*d* correspond to the verification protrusions 23*a*–23*d* on the support members 21*a*–21*d*, respectively, so that each developing device 10*a*–10*d* can be held by a prescribed support member 21*a*–21*d* of the rotatable support unit 20 by engaging the verification protrusion 23*a*–23*d* of the support member 21*a*–21*d* with the verification concavity 12*a*–12*d* of the developing device 10*a*–10*d*.

However, manufacturing must be carried out using molds corresponding to each of the developing devices 10*a*–10*d* in order to ensure that verification concavities 12*a*–12*d* are disposed at different locations on the developing devices 10*a*–10*d*, which leads to a higher manufacturing cost, and the developing devices 10*a*–10*d* cannot be used for any other colors but the originally designated toner color, resulting in a lack of versatility.

In addition, because verification concavities 12*a*–12*d* are disposed in the developing devices 10*a*–10*d* as described above, the volume of the interior of each developing device 10*a*–10*d* decreases, reducing the amount of toner in each developing device 10*a*–10*d*.

OBJECTS AND SUMMARY

An object of the present invention is to resolve the problems identified above in a color image forming apparatus in which multiple developing devices housing toners of different colors are held by support members that are disposed at prescribed locations on a rotatable support unit, and which performs development by rotating the rotatable support unit to sequentially lead each developing device to a position facing an image carrier. rotatable support unit to sequentially lead each developing device to a position facing an image carrier.

In other words, an object of the present invention is, in the color image forming apparatus described above, to have the developing devices easily held by prescribed support members on the rotatable support unit while using developing devices having the same configuration, without the need to dispose a verification concavity in each developing device at a different location for each developing device as in the conventional art, resulting in a lower manufacturing cost and increased versatility for each developing device, as well as in eliminating the reduction in the interior volume of each developing device, enabling a sufficient amount of toner to be housed in each developing device.

In order to attain the above object, the color image forming apparatus pertaining to the present invention comprises a color image forming apparatus in which multiple developing devices housing toners of different colors are held by support members disposed at prescribed locations on a rotatable support unit, and which performs development by rotating the rotatable support unit to sequentially lead each developing device to a position facing an image carrier, wherein a guide member is mounted to one side end of each developing device, and engaging members of different configurations are disposed in each guide member such that each of the multiple developing devices is held by a support member at a prescribed location on the rotatable support unit through engagement of the engaging members of the guide members mounted to adjacent developing devices.

Where a guide member is mounted to one side end of each developing device, and engaging members having different configurations are disposed in each guide member such that the engaging members of the guide members mounted to adjacent developing devices are made to engage with each other, as in the color image forming apparatus of the present invention, if during placement of the developing devices on the support members of the rotatable support unit a developing device is placed on the support member at a wrong location, the engaging members of the guide member mounted to the developing device do not engage with the engaging members of the guide members mounted to the adjacent developing devices, and as a result the developing device is prevented from being placed on the support member at a wrong location.

In addition, in the color image forming apparatus of the present invention, because a verification concavity need not be disposed in each developing device such that the verification concavity in each developing device is disposed at a different location for each developing device as in the conventional art, the interior volume of the developing devices does not decrease, enabling each developing device to house a sufficient amount of toner, and at the same time, because developing devices of the same configuration can be used, the developing device manufacturing cost can be reduced, and a toner different from the original toner can be housed in a given developing device, thereby increasing the versatility of the developing device.

In the color image forming apparatus of the present invention, when the multiple developing devices are placed on support members at prescribed locations on the rotatable support unit, one developing device is first placed on a support member at a prescribed location on the rotatable support unit, and subsequently the other developing devices are placed on the support members at prescribed locations on the rotatable support unit by engaging the engaging members of the guide members mounted to the developing devices, as described above.

It is preferred that a positioning member that enables at least one developing device to be placed on its corresponding support member on the rotatable support unit be included in order to ensure that the first developing device is placed on the support member at a prescribed location on the rotatable support unit without error.

The above problems are also resolved by a color image forming apparatus in which multiple developing devices housing toners of different colors are held by support members at prescribed locations on a rotatable support unit, and which performs development by rotating the rotatable support unit to sequentially lead each developing device to a position facing an image carrier, wherein such apparatus includes guide members mounted to one side end of each developing device, as well as a first engaging member disposed in the guide member mounted to a first developing device, a second engaging member that is mounted to a second developing device adjacent to the first developing device and can engage with the first engaging member, a third engaging member that is disposed in the guide member mounted to the second developing device and has a different configuration from the first and second engaging members, a fourth engaging member that is mounted to a third developing device adjacent to the second developing device and can engage with the third engaging member, and support members that hold the multiple developing devices at prescribed locations on the rotatable support unit through the engagement of the first and second engaging members and the third and fourth engaging members.

Furthermore, the above problems are also resolved by a color image forming apparatus in which four developing devices, i.e., first through fourth developing devices, which house toners of different colors, are held by support members at prescribed locations on a rotatable support unit, and which performs development by rotating the rotatable support unit to sequentially lead each developing device to a position facing an image carrier, wherein such apparatus includes guide members mounted to one side end of each of the developing devices, a first engaging member that is disposed in the guide member mounted to the first developing device, a second engaging member that is disposed in the guide member mounted to the second developing device adjacent to the first developing device and can engage with the first engaging member, a third engaging member that is disposed in the guide member mounted to the second developing device and that has a different configuration from the first and second engaging members, a fourth engaging member that is disposed in the guide member mounted to the third developing device adjacent to the second developing device and can engage with the third engaging member, a fifth engaging member that is disposed in the guide member mounted to the third developing device and that has a different configuration from the first through fourth engaging members, a sixth engaging member that is disposed in the guide member mounted to the fourth developing device adjacent to the third developing device and can engage with the fifth engaging member, a seventh engaging member that is disposed in the guide member mounted to the fourth developing device and that has a different configuration from the first through sixth engaging members, an eighth engaging member that is disposed in the guide member mounted to the first developing device adjacent to the fourth developing device and can engage with the seventh engaging member, and support members that hold the four developing devices at prescribed locations on the rotatable support unit through the engagement of the first and second engaging members, the third and fourth engaging members, the fifth and sixth engaging members and the seventh and eighth engaging members.

In addition, the above problems are also resolved by a method for manufacturing developing devices used in a color image forming apparatus in which guide members are mounted to one side end of each of multiple developing devices housing toners of different colors, engaging members having different configurations are disposed in the guide members, each developing device is held by a support member at a prescribed location on a rotatable support unit through the engagement of the engaging members of the guide members mounted to adjacent developing devices, and development is performed by sequentially leading each developing device to a position facing an image carrier through rotation of the rotatable support unit, such apparatus being manufactured by placing a toner of a prescribed color in a toner holder of each developing device and mounting a guide member having engaging members for that color to a prescribed area of the developing device.

By virtue of this construction, the developing device may be used for any color regardless of the color of the toner that was originally placed in the developing device, enabling easy recycling.

In the color image forming apparatus of the present invention having the above construction, because a guide member is mounted to one side end of each developing device and engaging members of different configurations are disposed in each guide member such that the engaging members of the guide members mounted to adjacent developing devices can be made to engage together when the multiple developing devices housing toners of different colors are placed on the support members at prescribed positions on the rotatable support unit, the engaging members of the guide member mounted to a developing device do not engage with the engaging members of the guide members mounted to the adjacent developing devices if the developing device is placed on a support member at an incorrect location. Consequently, the developing device is prevented from being placed on a support member at an incorrect location, and the developing devices are reliably placed on the support members at the prescribed locations on the rotational support unit.

In addition, in the color image forming apparatus of the present invention, because a verification concavity need not be disposed in each developing device such that the verification concavity in each developing device is at a different location for each developing device, as in the conventional art, the interior volume of the developing devices does not decrease and therefore each developing device can house a sufficient amount of toner, and at the same time, because developing devices having a uniform configuration can be used, the developing device manufacturing cost can be reduced, and toner different from the original toner may be housed in a given developing device, which increases the versatility of the developing device.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

A color image forming apparatus pertaining to an embodiment of the present invention is specifically described below with reference to the accompanying drawings.

Figure 2:
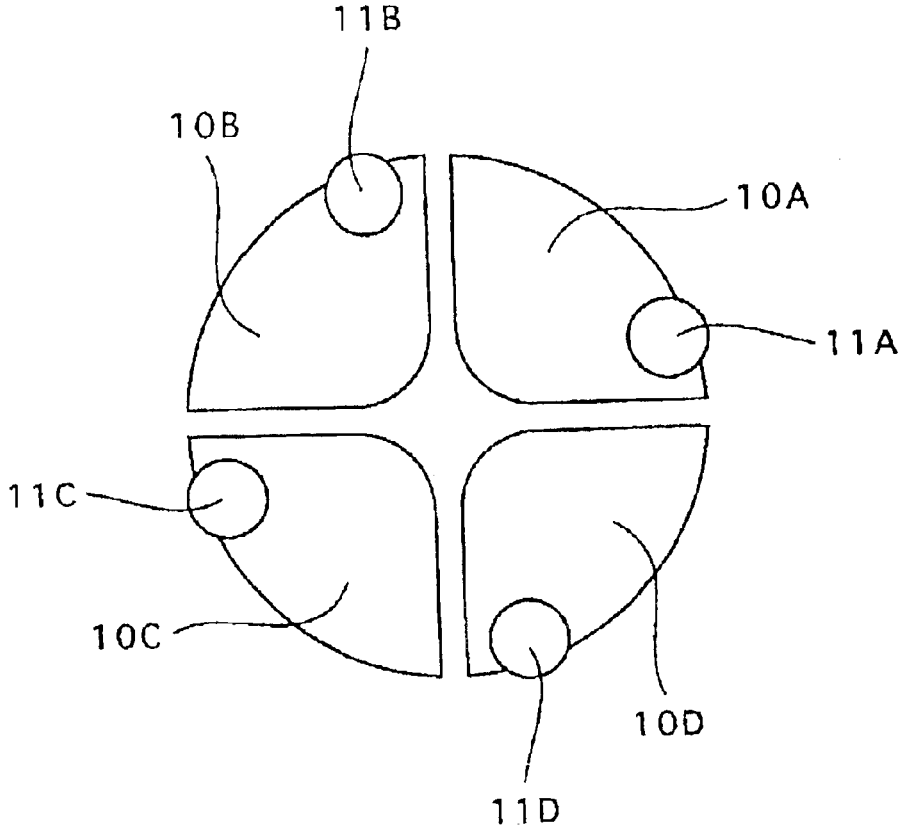
FIG. 2 is a schematic explanatory drawing showing each developing device used in a color image forming apparatus pertaining to one embodiment of the present invention.

As in the color image forming apparatus of the conventional art, the color image forming apparatus of this embodiment pertaining to the present invention uses four developing devices 10A–10D as shown in FIG. 2, each of which houses a toner of a different color, such as yellow, magenta, cyan and black, for example.

Figure 3:
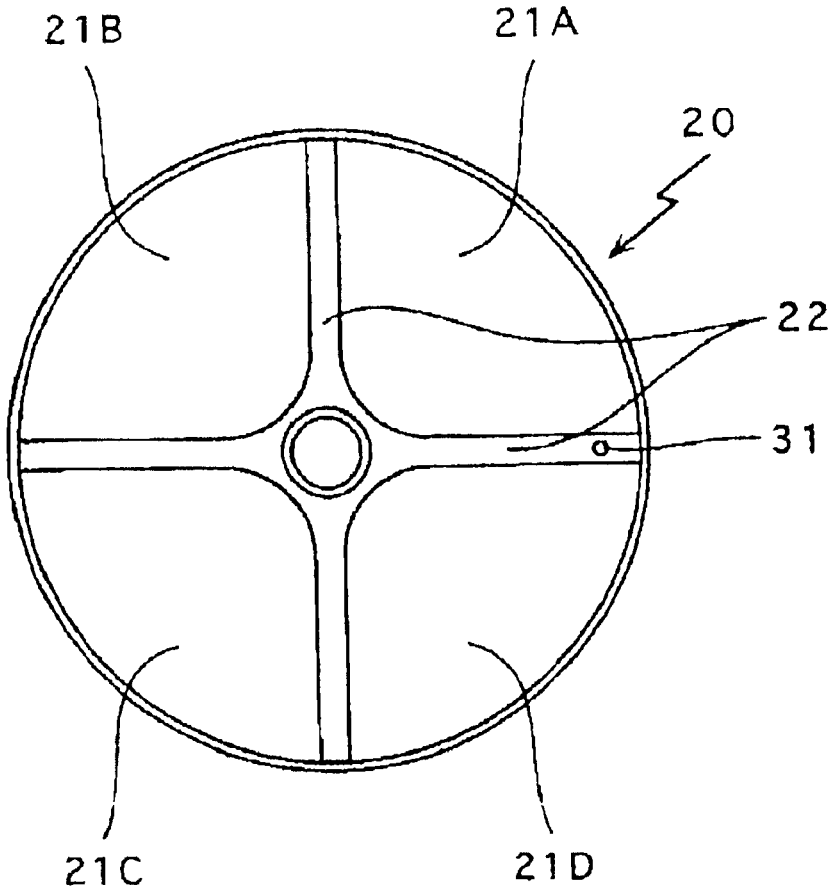
FIG. 3 is a schematic explanatory drawing showing a rotatable support unit used in the color image forming apparatus of the above embodiment.

In the color image forming apparatus of this embodiment, as shown in FIG. 3, a cross-shaped partition member 22 is disposed on a rotatable support unit 20 on which the four developing devices 10A–10D are held, such that it separates the rotatable support unit 20 into four support members 21A–21D that respectively support the four developing devices 10A–10D and a positioning pin 31, which serves as a positioning member 30 that determines the position of one developing device, i.e., the developing device 10A, protrudes from an appropriate location of the partition member 22.

Figure 4:
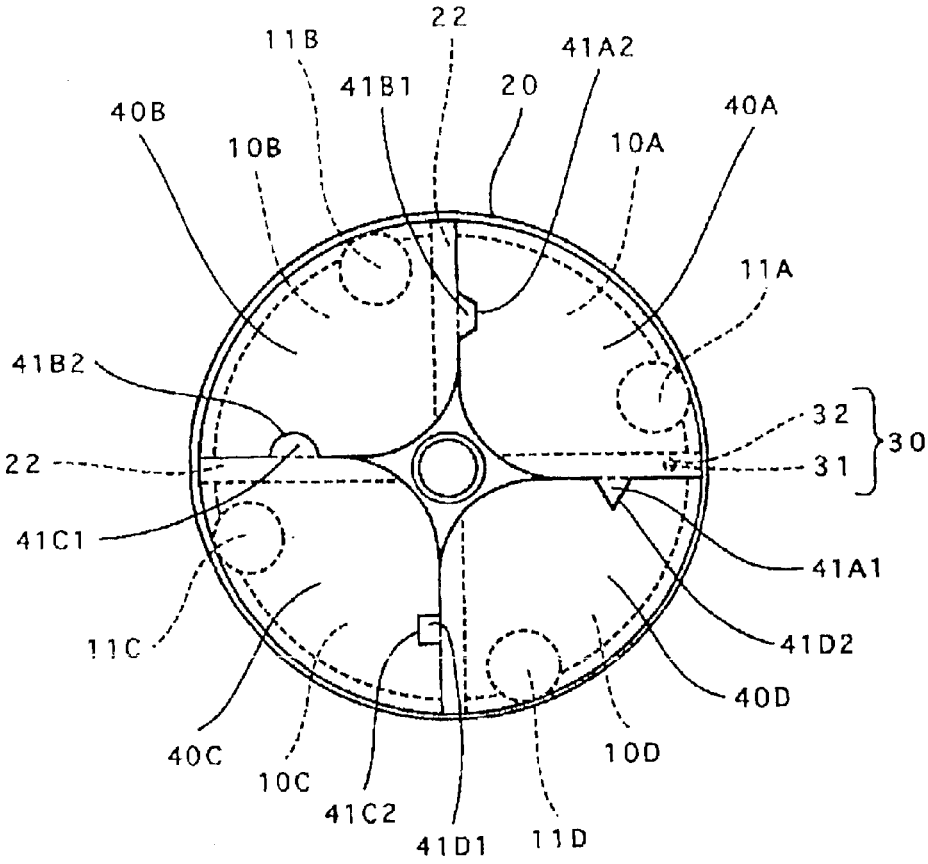
FIG. 4 is a schematic front elevation showing the color image forming apparatus of the above embodiment where the multiple developing devices are held by the support members at prescribed locations on a rotatable support unit.
Figure 5:
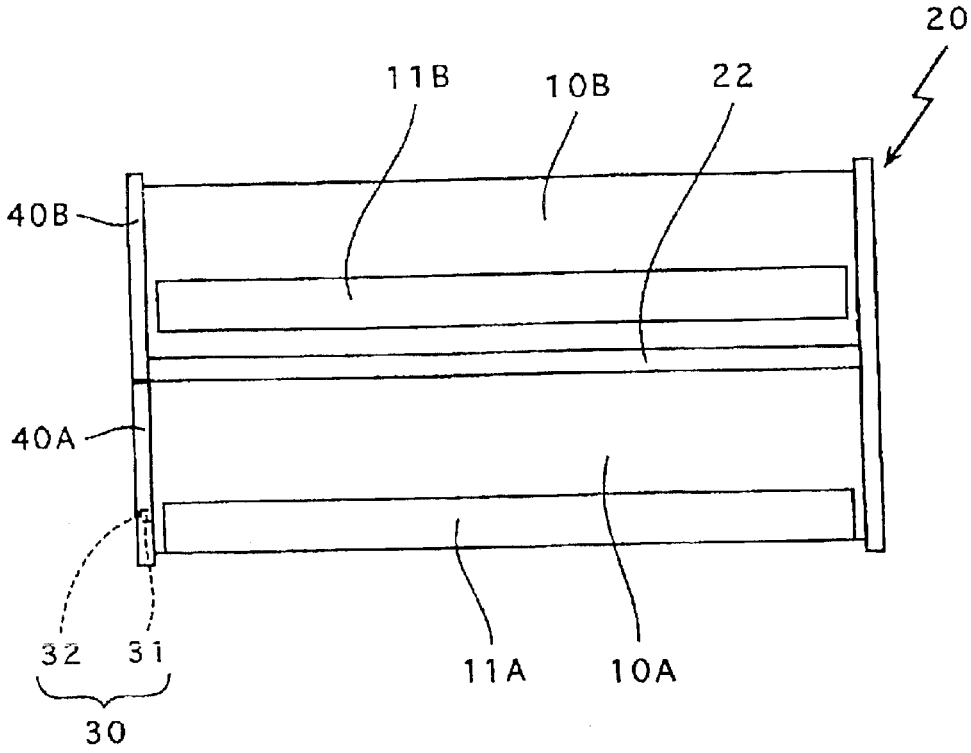
FIG. 5 is a schematic plan view showing the color image forming apparatus of the above embodiment where the multiple developing devices are held by the support members at prescribed locations on a rotatable support unit.

In the color image forming apparatus of this embodiment, as shown in FIGS. 4 and 5, guide members 40A–40D are attached to one side end of each developing device 10A–10D, and the developing devices 10A–10D having the guide members 40A–40D, respectively, are held by the four support members 21A–21D on the rotatable support unit 20.

In this embodiment, disposed on the first guide member 40A mounted to the first developing device 10A are a first engaging member 41A1 comprising a triangular protrusion, which is disposed at an area of the first guide member 40A contacting the fourth guide member 40D, and a second engaging member 41A2 comprising a trapezoidal concavity, which is disposed at an area of the first guide member 40A contacting the second guide member 40B. Furthermore, a hole 32 in which a positioning pin 31 disposed on the partition member 22 is inserted is disposed on the surface of the first guide member 40A, such surface being the surface by which the first guide member 40A is mounted to the first developing device 10A.

In addition, disposed on the second guide member 40B mounted to the second developing device 10B are a first engaging member 41B1 that comprises a trapezoidal protrusion and is designed to engage with the second engaging member 41A2 on the first guide member 40A, such first engaging member 41B1 being disposed at an area of the second guide member 40B contacting the first guide member 40A, and a second engaging member 41B2 comprising a semicircular concavity, which is disposed at an area of the second guide member 40B that is in contact with the third guide member 40C.

Furthermore, disposed on the third guide member 40C mounted to the third developing device 10C are a first engaging member 41C1 that comprises a semicircular protrusion and is designed to engage with the second engaging member 41B2 on the second guide member 40B, such first engaging member 41C1 being disposed at an area of the third guide member 40C that is in contact with the second guide member 40B, as well as a second engaging member 41C2 comprising a square concavity, which is disposed at an area of the third guide member 40C that is in contact with the fourth guide member 40D.

Moreover, disposed on the fourth guide member 40D mounted to the fourth developing device 10D are a first engaging member 41D1 that comprises a square protrusion and is designed to engage with the second engaging member 41C2 on the third guide member 40C, such first engaging member 41D1 being disposed at an area of the fourth guide member 40D that is in contact with the third guide member 40C, as well as a second engaging member 41D2 comprising a triangular concavity that engages with the first engaging member 41A1 of the first guide member 40A, which is disposed at an area of the fourth guide member 40D contacting the first guide member 40A.

After mounting the corresponding guide members 40A–40D to one side end of each developing device 10A–10D, respectively, as described above, the first developing device 10A to which the first guide member 40A is mounted is led to the first support member 21A on the rotatable support unit 20, and the positioning pin 31 disposed on the partition member 22 of the rotatable support unit 20 is inserted in the hole 32 disposed in the first guide member 40A such that the first developing device 10A can be held by the first support member 21A of the rotatable support unit 20. If an attempt is made to have the first support member 21A hold any of the other developing devices 10B–10D, because the guide members 40B–40D mounted to the other developing devices 10B–10D do not have a hole matching the configuration of the hole described above, the positioning pin 31 on the rotatable support unit 20 collides with the guide members 40B–40D, thereby preventing the other developing devices 10B–10D from being held by the first support member 21A by mistake.

After the first developing device 10A to which the first guide member 40A is mounted is placed on the first support member 21A on the rotatable support unit 20, the second engaging member 41A2 of the first guide member 40A and the first engaging member 41B1 of the second guide member 40B mounted to the second developing device 10B engage together, whereby the second developing device 10B is placed on the second support member 21B on the rotatable support unit 20.

The second engaging member 41B2 of the second guide member 40B then engages with the first engaging member 41C1 of the third guide member 40C mounted to the third developing device 10C, whereby the third developing device 10C is placed on the third support member 21C on the rotatable support unit 20.

Furthermore, the second engaging member 41C2 of the third guide member 40C engages with the first engaging member 41D1 of the fourth guide member 40D mounted to the fourth developing device 10D, and the first engaging member 41A1 of the first guide member 40A engages with the second engaging member 41D2 of the fourth guide member 40D, whereby the fourth developing device 10D is placed on the fourth support member 21D on the rotatable support unit 20.

When the second through fourth developing devices 10B–10D are placed on the second through fourth support members 21B–21D on the rotatable support unit 20, if the second through fourth developing devices 10B–10D are placed in an incorrect location, the engaging members 41A1, 41A2, . . . of the first through fourth guide members 40A–40D do not engage well with each other, thereby preventing misplacement of the second through fourth developing devices 10B–10D.

Figure 1:
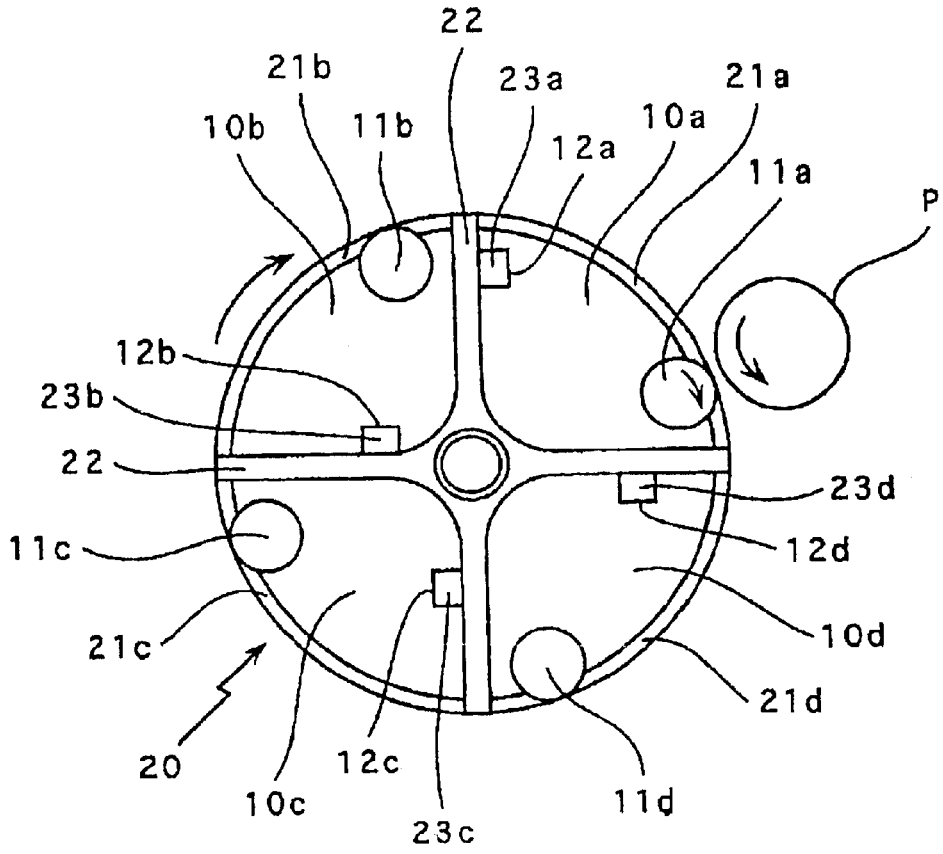
FIG. 1 is a schematic explanatory drawing showing a conventional color image forming apparatus in which multiple developing devices are held by support members at prescribed locations on a rotatable support unit.

In addition, in the color image forming apparatus of this embodiment, because the developing devices 10A–10D can be held by the prescribed support members 21A–21D on the rotational support unit 20, respectively, using the guide members 40A–40D mounted to the developing devices 10A–10D, it is not necessary to include verification concavities 12*a*–12*d* in the developing devices 10*a*–10*d*, as in the case of the color image forming apparatus of the conventional art shown in FIG. 1, and therefore the developing devices 10A–10D can have a uniform configuration, making the manufacture thereof easier and thereby leading to a reduction in manufacturing cost and increased versatility. Moreover, because there is no reduction in the interior volume of the developing devices 10A–10D, a larger amount of toner can be housed in each developing device.

In addition, when the toner in the developing devices 10A–10D has been depleted and must be replaced, by mounting a guide member 40A–40D that corresponds to the color of the refill toner after it is placed in the toner holder of the developing device, the developing device can be used as a developing device for that color regardless of the color of the toner originally housed therein. When toner of a different color is to be used, however, the used developing device should be thoroughly cleaned in order to ensure that the old toner does not mix with the new toner.

This construction increases the versatility of the developing devices, and enables the developing devices to be recycled as well.

Figure 6:
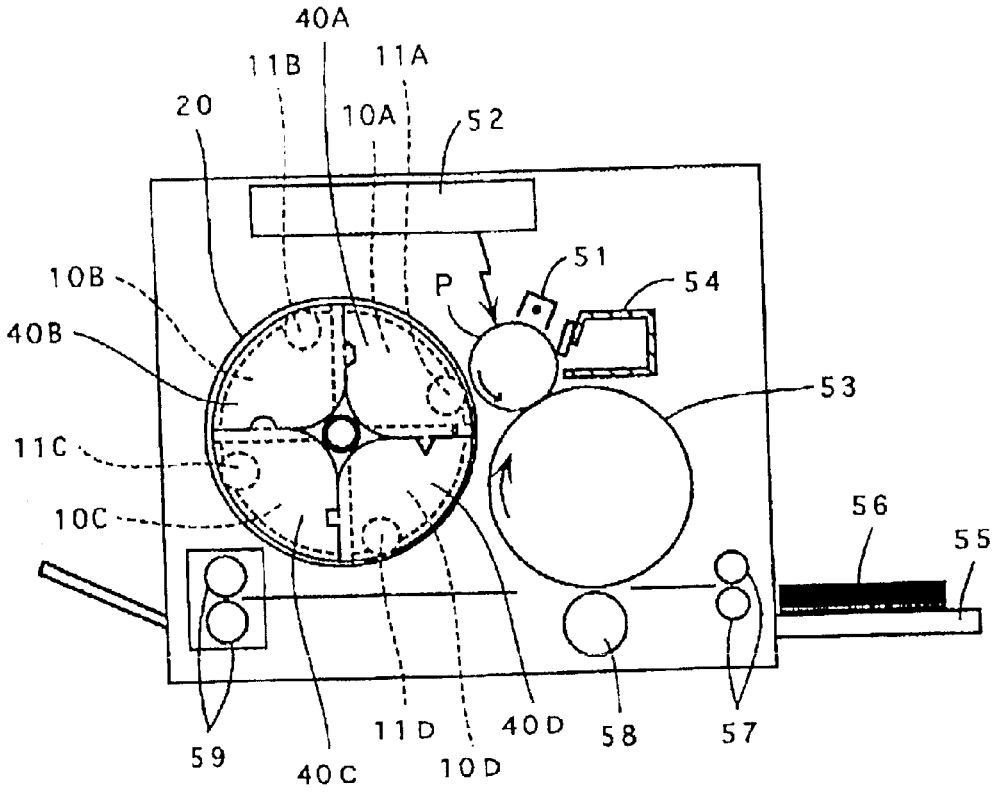
FIG. 6 is a schematic explanatory drawing showing the construction of a color image forming apparatus of the above embodiment.

In the color image forming apparatus of this embodiment, where color images are formed with yellow toner housed in the first developing device 10A, magenta toner housed in the second developing device 10B, cyan toner housed in the third developing device 10C and black toner housed in the fourth developing device 10D, as shown in FIG. 6, the toner carrier 11A of the first developing device 10A housing yellow toner is first positioned such that it faces an image carrier P. The image carrier P is then rotated to allow the image on the surface of the image carrier P to be charged by a charger 51, and the charged image carrier P is exposed by an exposure device 52 in accordance with image signals to form an electrostatic latent image on the surface of the image carrier P.

In the development area in which the image carrier P on which the electrostatic latent image has been formed in this way and the toner carrier 11A of the first developing device 10A face each other, yellow toner is supplied to the electrostatic latent image on the image carrier P from the toner carrier 11A, thereby forming a yellow toner image on the image carrier P that corresponds to the electrostatic latent image.

While the yellow toner image formed on the image carrier P in this fashion is transferred to an intermediate transfer member 53, the yellow toner remaining on the surface of the image carrier P after transfer is removed therefrom by a cleaning device 54.

The rotatable support unit 20 is then rotated such that the toner carrier 11B of the second developing device 10B housing magenta toner is positioned to face the image carrier P. a magenta toner image is formed on the surface of the image carrier P in the same manner as with the first developing device 10A, and the magenta toner image is transferred to the intermediate transfer member 53 on which the yellow toner image has been transferred. The magenta toner remaining on the image carrier P is removed therefrom by the cleaning device 54 after transfer.

Through the identical operations, a cyan toner image is formed on the surface of the image carrier P by the third developing device 10C housing cyan toner and the cyan toner image is transferred to the intermediate transfer member 53, and similarly, a black toner image is formed on the surface of the image carrier P by the fourth developing device 10D housing black toner and the black toner image is transferred to the intermediate transfer member 53. A full-color toner image is thereby formed on the intermediate transfer member 53 through the transfer of yellow, magenta, cyan and black toner images.

A recording sheet 56 is sent from a paper cassette 55 disposed at the bottom area of the color image forming apparatus and is led by conveyance rollers 57 to an area in which the intermediate transfer member 53 faces a transfer roller 58, whereby the full-color toner image formed on the intermediate transfer member 53 is transferred to the recording sheet 56. The full-color toner image transferred to the recording sheet 56 in this fashion is then fused thereon by a fusing device 59 and the recording sheet 56 is ejected.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A color image forming apparatus in which multiple developing devices housing toners of different colors are held by support members at prescribed locations on a rotatable support unit, and which performs development by rotating the rotatable support unit to sequentially lead each of the multiple developing devices to a position facing an image carrier, comprising:

guide member which are mounted to one side end of each of the multiple developing devices; and engaging members of different configurations are disposed in each guide member, such that each of the multiple developing devices is held by one of the support members at a prescribed location on the rotatable support unit through engagement of the engaging members of the guide members mounted to adjacent developing devices.

2. The color image forming apparatus according to claim 1, wherein said apparatus includes a positioning member which determines positioning for at least one developing device such that it is placed on its corresponding support member on the rotatable support unit when the multiple developing devices are placed on the support members at prescribed locations on the rotatable support unit.

3. A color image forming apparatus in which multiple developing devices housing toners of different colors are held by support members at prescribed locations on a rotatable support unit, and which performs development by rotating the rotatable support unit to sequentially lead each of the multiple developing devices to a position facing an image carrier, wherein such apparatus comprising:

guide members which are mounted to one side of each developing device;

a first engaging member which is disposed in the guide member mounted to a first developing device;

a second engaging member for engaging with the first engaging member, which is mounted to a second developing device adjacent to the first developing device;

a third engaging member which is disposed in the guide member mounted to the second developing device and has a different configuration from the first and second engaging members;

a fourth engaging member for engaging with the third engaging member which is mounted to a third developing device adjacent to the second developing device; and a support unit for holding the multiple developing devices at prescribed locations on the rotatable support unit through the engagement of the first and second engaging members and the third and fourth engaging members.

4. The color image forming apparatus according to claim 3, wherein said apparatus includes a positioning member which determines positioning for the first developing device such that it is placed on its corresponding support member on the rotatable support unit when the multiple developing devices are placed on the support members at prescribed locations on the rotatable support unit.

5. The color image forming apparatus according to claim 3, wherein said apparatus includes a positioning member which determines positioning for the second developing device such that it is placed on its corresponding support member on the rotatable support unit when the multiple developing devices are placed on the support members at prescribed locations on the rotatable support unit.

6. The color image forming apparatus according to claim 3, wherein the second and fourth engaging members are disposed in the guide members.

7. The color image forming apparatus according to claim 6, wherein the guide members in which the first through fourth engaging members are disposed are detachably mountable to a developing device.

8. A color image forming apparatus in which four developing devices, first through fourth developing devices, housing toners of different colors are held by support members at prescribed locations on a rotatable support unit, and which performs development by rotating the rotatable support unit to sequentially lead each developing device to a position facing an image carrier, wherein such apparatus comprising:

guide members mounted to one side end of each of the developing devices;

a first engaging member which is disposed in the guide member mounted to the first developing device;

a second engaging member which is disposed in the guide member mounted to the second developing device adjacent to the first developing device and for engaging with the first engaging member;

a third engaging member which is disposed in the guide member mounted to the second developing device and has a different configuration from the first and second engaging members;

a fourth engaging member which is disposed in the guide member mounted to the third developing device adjacent to the second developing device and for engaging with the third engaging member;

a fifth engaging member which is disposed in the guide member mounted to the third developing device and has a different configuration from the first through fourth engaging members;

a sixth engaging member which is disposed in the guide member mounted to the fourth developing device adjacent to the third developing device and for engaging with the fifth engaging member;

a seventh engaging member which is disposed in the guide member mounted to the fourth developing device and has a different configuration from the first through sixth engaging members;

an eighth engaging member which is disposed in the guide member mounted to the first developing device adjacent to the fourth developing device and for engaging with the seventh engaging member; and and support members which hold the four developing devices at prescribed locations on the rotatable support unit through the engagement of the first and second engaging members, the third and fourth engaging members, the fifth and sixth engaging members and the seventh and eighth engaging members.

9. The color image forming apparatus according to claim 8, wherein said apparatus includes a positioning member which determines positioning for the first developing device such that it is placed on its corresponding support member on the rotatable support unit when the multiple developing devices are placed on the support members at prescribed locations on the rotatable support unit.

10. The color image forming apparatus according to claim 8, wherein the guide members in which the first through fourth engaging members are disposed are detachably mountable to a developing device.

11. A method for manufacturing developing devices used in a color image forming apparatus in which guide members are mounted to one side end of each of multiple developing devices housing toners of different colors, engaging members having different configurations are disposed in the guide members, each developing device is held by a support member at a prescribed location on a rotatable support unit through the engagement of the engaging members of the guide members mounted to adjacent developing devices, and development is performed by sequentially leading each developing device to a position facing an image carrier through rotation of the rotatable support unit, said method having the steps of:

placing a toner of a prescribed color in a toner holder of each developing device; and mounting a guide member having engaging members for that color to a prescribed area of the developing device.

12. The developing device manufacturing method according to claim 11, wherein said method also includes the step of cleaning toner remaining in the developing device before placing toner therein.

* * * * *